US005354426A

United States Patent [19]

Rucker

[11] Patent Number: 5,354,426

[45] Date of Patent: Oct. 11, 1994

[54] APPARATUS AND METHOD FOR REMOVING DEBRIS FROM FORMING WIRE

[75] Inventor: Kevin S. Rucker, Pasco, Wash.

[73] Assignee: Boise Cascade Corporation, Boise, Id.

[21] Appl. No.: 38,009

[22] Filed: Mar. 29, 1993

[51] Int. Cl.[5] ..... D21F 1/30; D21F 1/32

[52] U.S. Cl. ..... 162/199; 162/274; 162/275; 162/301

[58] Field of Search ..... 162/272, 274, 275, 279, 162/301, 352, 199

[56] References Cited

U.S. PATENT DOCUMENTS

| | | | |
|---|---|---|---|
| 3,403,073 | 9/1965 | Moran | 162/352 |
| 4,544,449 | 10/1985 | Arav | 162/352 |
| 4,559,105 | 12/1985 | Sennett et al. | 162/352 |
| 4,648,943 | 3/1987 | Malashenko et al. | 162/352 |
| 4,802,954 | 2/1989 | Malashenko | 162/352 |
| 4,880,500 | 11/1989 | Eldridge | 162/275 |
| 5,084,138 | 1/1992 | Ewald | 162/301 |
| 5,116,477 | 5/1992 | Bubik et al. | 162/301 |
| 5,160,583 | 11/1992 | Eaton et al. | 162/301 |
| 5,202,000 | 4/1993 | Phillips | 162/301 |

OTHER PUBLICATIONS

Smook, G. A., *Handbook for Pulp & Paper Technologists*, Chapt. 16, pp. 208–243 (1989).

*Primary Examiner*—Karen M. Hastings
*Attorney, Agent, or Firm*—Klarquist Sparkman Campbell Leigh & Whinston

[57] ABSTRACT

A blade mounting frame is attached to a support structure having an endless forming wire rotatably mounted thereon. At least one turn shoe is mounted to the support structure for guiding the rotating path of the forming wire. A blade assembly attached to the blade mounting frame includes a blade in contact with the wire for removing debris from the forming wire before the debris is caught at a nip between the rotating wire and the turn shoes.

19 Claims, 2 Drawing Sheets

APPARATUS AND METHOD FOR REMOVING DEBRIS FROM FORMING WIRE

TECHNICAL FIELD

This invention relates to a blade assembly and method for removing debris accumulated on a forming wire in a paper-making machine.

BACKGROUND OF THE INVENTION

Paper-making machines are designed to produce paper at high production rates, and therefore are equipped with rapidly moving forming wires. Vertical paper making machines such as the Bel Baie type vertical formers manufactured by the Beloit Corporation utilize two opposed forming wires between which the forming sheet of paper is sandwiched.

In some cases, the turn shoe assemblies on the wet end sections of vertical formers rely on stationary convex ceramic turning shoes to guide and turn the forming wire as it rotates or travels around the machine. Such ceramic turning shoes are advantageous for various reasons, including quality enhancement to the paper, ease of maintenance due to fewer moving parts than traditional drum turning assemblies, and the increased durability of the ceramic material.

The forming wire in a vertical former travels around the stationary turn shoes under tension so that the inner surface of the wire moves over the smooth convex surface of the turn shoe as the forming wire changes direction. This creates a nip at the point where the wire meets each turning shoe. During the paper-making process, debris may fall onto the inner surface of the wire and accumulate thereon. Such debris often includes rust chips that fall onto the wire from other parts of the machine, dried hard stock that falls onto the wire, or accumulations of fiber. This typically occurs during start-up of the machine, but may occur at any time. As the rapidly moving wire moves past the stationary turning shoes, debris that falls onto the wire accumulates and becomes trapped at the nip between the shoes and the wire. This can lead to excessive wear on the wire, which is typically formed of plastics, such as polyester and nylon, shortening the useful life of the wire. In extreme cases, hard pieces of debris caught at the nip between the turning shoe and the wire may be pushed through the taut wire, producing a hole in the wire that reduces the quality of the paper and eventually requires replacement of the wire. Such debris may in some cases also damage the ceramic turning shoes.

Prior attempts at removing debris from the inner surface of the forming wire upstream from the turning shoes have been largely unsuccessful. For example, hosing the inner surface of the wire with water during start-up has been used as a method of removing debris, but is unreliable.

Therefore, there is a need for an improved apparatus and method that reliably removes debris from the inner surface of forming wires used in paper-making machines that have stationary ceramic turn shoes.

SUMMARY OF THE INVENTION

The present invention relates to a blade assembly that removes debris from the inner surface of a rapidly traveling forming wire upstream from the stationary turning shoes. The assembly includes a blade or skiver transverse to, and in contact with the inner surface of the wire upstream from the turning shoes. The blade acts as a foil to remove debris accumulated on the wire as the wire moves past the blade, and before the debris may become trapped at the nip between the stationary ceramic shoes and the wire. Removal of debris from the inner surface of the wire substantially reduces wear or damage to the wire.

A water shower is directed onto the wire immediately upstream of the leading edge of the blade. The water lubricates and cools the blade and the wire, and also functions as a medium for flushing out, collecting and transporting the debris into a debris collecting structure. The debris collecting structure is positioned downstream from the blade but upstream from the ceramic shoes, and accumulates the debris removed from the forming wire.

DESCRIPTION OF THE PREFERRED EMBODIMENTS

Figure 1:
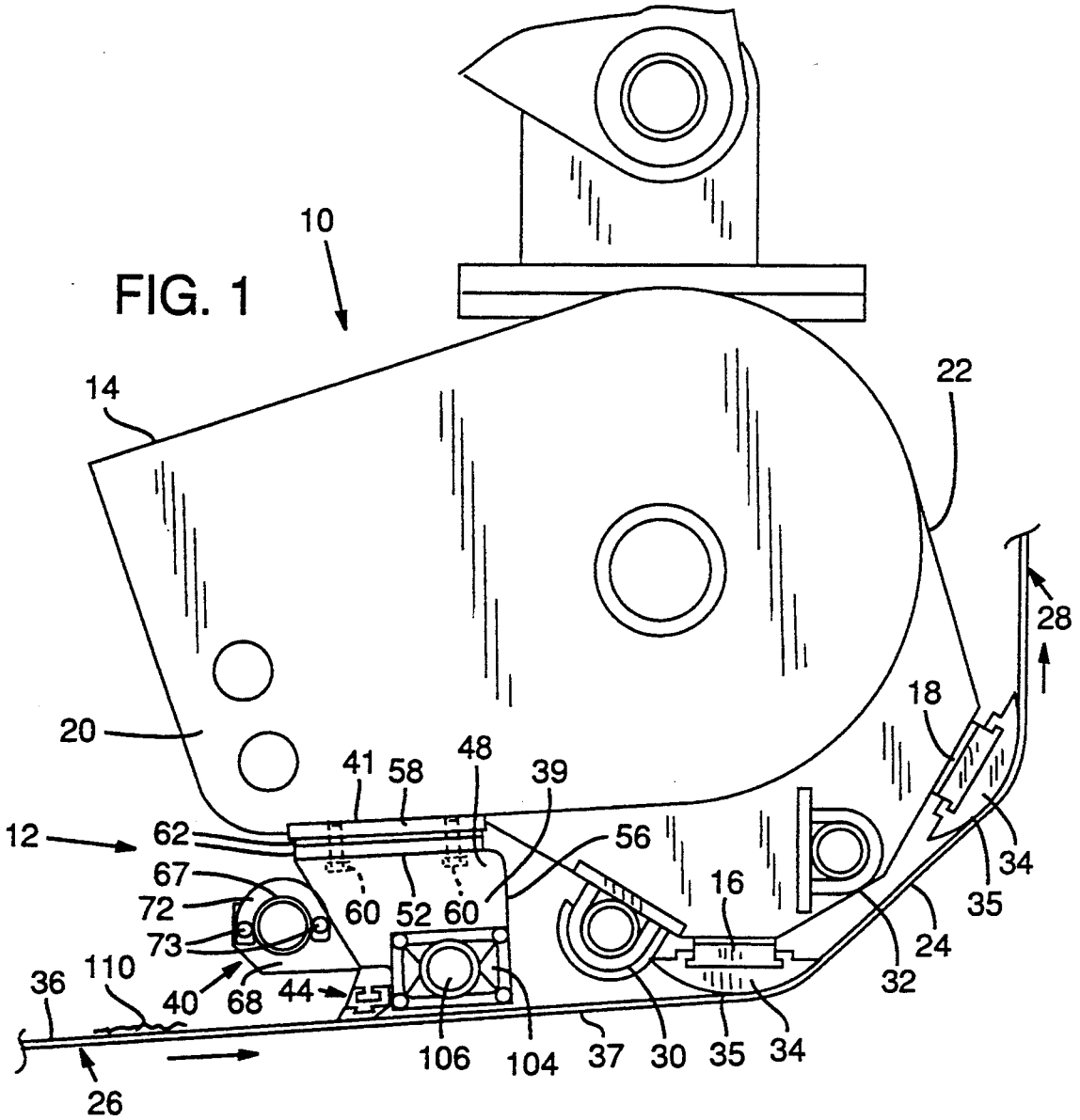
FIG. 1 is a side elevational view of the wet end of a turn shoe assembly of a vertical forming machine, including a blade mounting frame mounted to the turn shoe assembly support structure.

One preferred embodiment of a turn shoe assembly 10 of the wet-end section of a vertical paper-making machine, such as a Bel Baie type machine, is shown generally in FIG. 1. The remainder of the machine is not illustrated.

Support Structure

Turn shoe assembly 10 comprises a wet end support structure 14, to which stationary guide shoes, or turn shoes 16 and 18 are mounted. Support structure 14 has a forward end 20 and a rearward end 22.

An endless forming wire 24 is mounted on support structure 14 such that wire 24 is guided and turned by turn shoes 16 and 18. Guiding rolls can also be used instead of the turn shoes. Forming wire 24 moves in the direction shown by the arrows in FIG. 1, defining an upstream end 26 and a downstream end 28 relative to turn shoes 16 and 18, and forward end 20 and rearward end 22 of the support structure. Wire 24 is a conventional wire used in the paper manufacturing industry. Thus, wire 24 is preferably, but not necessarily, made of plastics such as polyester or nylon monofilaments to form a continuous belt or loop having an inner surface 36 and an outer surface 37. Only the wet end turn shoe assembly of the paper making machine is illustrated in FIG. 1. Thus, the remaining length of wire 24 is not illustrated.

A pair of showers 30, 32 are mounted to rearward end 22 of support structure 14 so that shower 30 is upstream from turn shoe 16, and shower 32 is upstream from turn shoe 18. The showers discharge a continuous stream of fluid, such as water, onto wire 24 to cool and lubricate the wire as it moves past the shoes. Showers 30 and 32 extend across the entire width of the wire and discharge water across the width of the wire.

Each of the turn shoes 16, 18 has a convex outer face 34. The outer faces are smooth and are preferably made of a ceramic material such as zirconia.

The wire is mounted on the paper making machine under tension, and is therefore urged against turn shoes 16 and 18 as the wire rotates. The rotating path of the wire is thus guided by the turn shoes so that the inner surface 36 of the wire bears on the convex outer faces of the turn shoes, forming a nip point between wire 24 and the outer convex face of each turn shoe. Thus, a nip 35 is formed between shoe 16 and wire 24, and between shoe 18 and wire 24.

Blade Mounting Frame and Blade Assembly

Figure 2:
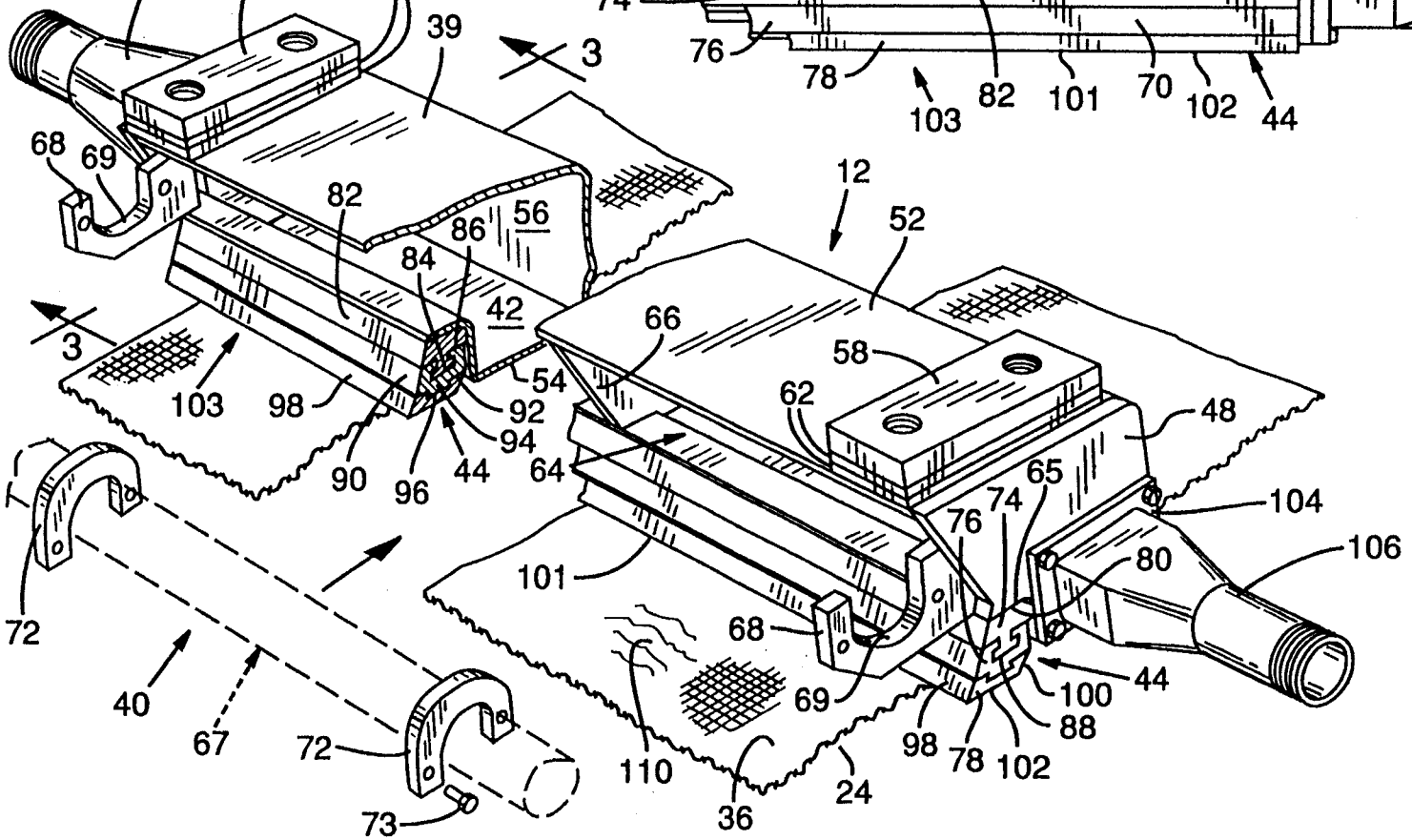
FIG. 2 is a perspective fragmentary view of the blade mounting frame of the present invention, showing the shower bar assembly detached from the blade mounting frame.

One preferred embodiment of a wire skiver assembly, or blade mounting frame 12 is shown in FIGS. 1 through 4. Blade mounting frame 12 is mounted to a flat portion of underside 41 of support structure 14 at forward end 20 so that blade mounting frame 12 is positioned between support structure 12 and wire 24. As illustrated in FIG. 2, blade mounting frame 12 extends across the entire width of wire 24, transverse to the rotational direction of wire 24 so that the longitudinal axis of blade mounting frame 12 is, preferably, but necessarily, substantially perpendicular to the direction of wire rotation (illustrated by arrows in FIGS. 1 and 2).

In an alternative embodiment (not shown), the blade mounting frame 12 may extend across the width of the wire at an angle that is not perpendicular to the direction of wire rotation.

Blade mounting frame 12 generally includes an elongated open box-shaped housing 39, a shower 40, a collection box 42 and a foil blade assembly 44. Box-shaped housing 39 has an open upstream end, and includes opposite outer end wall members 48, 50, and upper and lower walls 52, 54 that are interconnected by a downstream vertical wall 56. Lower wall 54 includes a flattened portion 65 to which the foil blade assembly 44 is preferably mounted, as described below. The box-shaped housing 39 has an elongated opening 64 on the upstream side that defines an opening into the interior of the housing. The housing thus forms a U-shaped collection box 42 (FIG. 3), which is defined by the combination of lower wall 54, downstream wall 56, and opposite end wall members 48 and 50. A plurality of spaced apart brackets 66 (FIG. 2) extend vertically across opening 64 to provide rigidity and support for the blade mounting frame.

Mounting plates 58 are welded or otherwise attached to underside 41 of support structure 14. Blade mounting frame 12 is attached to mounting plates 58 of support structure 14 by bolts 60 extending through upper wall 52 of housing 39 and into threaded openings formed in mounting plate 58.

As shown in FIG. 2, blade mounting frame 12 is attached to structure 14 by bolting housing 39 to mounting plate 58 at several spaced apart locations across the width of the housing. The number of mounting bolts and locations is not critical, so long as the blade mounting frame is firmly attached to the support structure. The blade mounting frame may also be mounted to a support structure independent of the paper machine.

The vertical position of blade mounting frame 12 (FIG. 4) is adjustable relative to support structure 14 so that the foil blade assembly 44 that is attached may be moved toward or away from wire 24. Thus, shims 62 are inserted between upper wall 52 of housing 39 and mounting plate 58. As detailed below, the shims are used to vary the pressure at the nip between forming wire 24 and a blade 78.

A shower 40 (FIG. 3) extends across the width of blade mounting frame 12, immediately upstream and adjacent thereto. A shower support bracket 68 (shown in FIG. 2 without pipe 67) is attached to each end wall 48, 50 of housing 39. Multiple intermediate shower support brackets 68 may also be provided.

Figure 3:
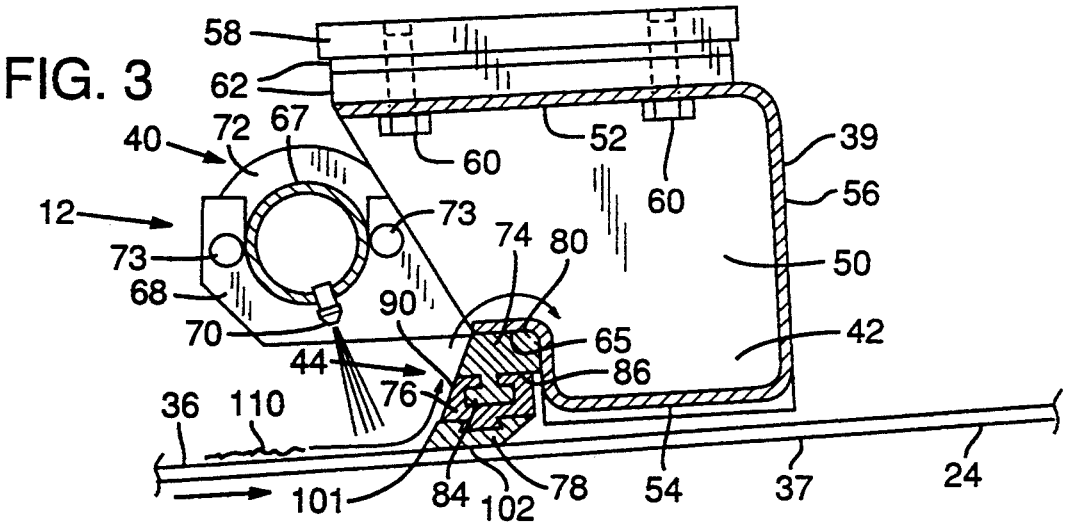
FIG. 3 is a cross-sectional view of the blade mounting frame of FIG. 2, taken along line 3—3 of FIG. 2.
Figure 4:
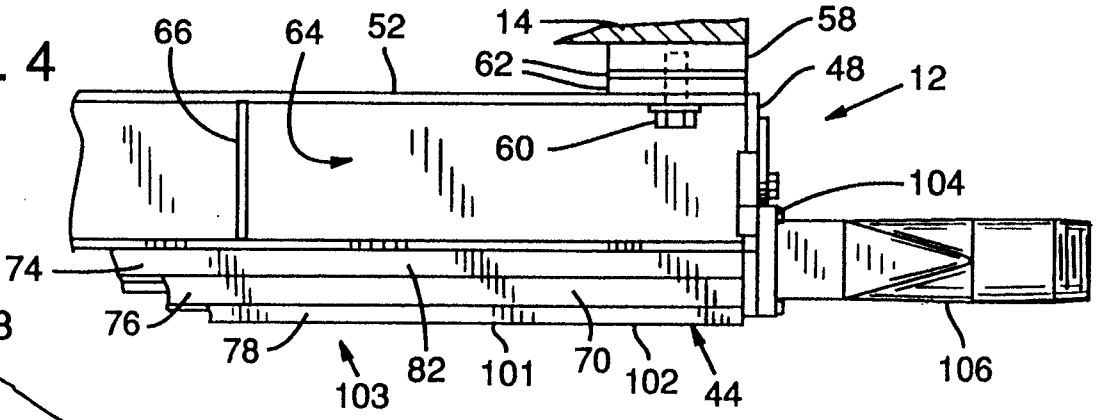
FIG. 4 is a front elevational view of a portion of the blade mounting frame of FIG. 2.

As shown in FIG. 2, each support bracket 68 includes a U-shaped seat 69 for receiving and supporting the shower 40, which uses a cylindrical fluid-carrying pipe 67, one end of which is connected to a fluid supply (not shown). As explained below, pipe 67 is placed into the U-shaped seats 69 of brackets 68 so that shower heads 70 (one of which is shown in FIG. 3) direct a stream of fluid onto forming wire 24 immediately upstream from the leading edge of the blade. Shower heads 70 are configured to spray a fluid, such as water, onto forming wire 24 substantially over the entire transverse width of the wire.

Clamps 72 are mounted to the two outermost support brackets 68 by bolts 73, and hold shower 40 in place in the support bracket.

Blade assembly 44 is mounted to flattened portion 65 of lower wall 54, immediately downstream of shower 40 as shown in FIG. 3. Blade assembly 44 includes a blade holder 74, and a removable base 76 that is positioned intermediately between blade holder 74 and a blade 78. The blade holder 74 has a flattened upper surface 80 that is attached to flattened portion 65 of lower wall 54. The upstream face 82 of blade holder 74 is inclined, and there is a downwardly projecting T-bar 84 projecting from the lower surface 86.

Base 76 has a T-shaped groove 88 in its upper face that corresponds in shape to projecting T-bar 84. Base 76 may be slid onto and removed from blade holder 74 by fitting T-bar 84 into groove 88, and sliding base 76 along blade holder 74. Base 76 also has an inclined face 90 that is flush with face 82 when base 76 is assembled with T-bar 84. A lower surface 92 of base 76 has a longitudinal chamfered protrusion 94. Base 76 is preferably made of fiber reinforced composite materials including such fibers as fiberglass, carbon and aramid fibers.

Blade 78 and base 76 are connected together as a modular unit. Thus, the upper surface of blade 78 has a longitudinal channel 96 at its upper surface that corresponds in shape to chamfered protrusion 94. Blade 78 is permanently affixed or fixedly mounted to base 76 by inter-connecting protrusion 94 with channel 96, as by gluing. The combination blade/base is removably mounted to the blade holder and this may be interchangeably removed from the blade assembly by sliding the combination onto T-bar 84.

Blade 78 has an inclined upstream face 98 and a horizontal flattened bottom surface 102 to define a blade leading edge 101 at the intersection of face 98 and bottom surface 102. The downstream face 100 of blade 78 is also inclined. Bottom surface 102 of blade 78 is substantially parallel to and in contact with inner surface 34 of forming wire 24 across the entire bottom surface 102 of the blade and across the entire width of wire 24 when blade mounting frame 12 is fully assembled.

Blade 78 is preferably but not necessarily made of a ceramic material such as silicon nitride. Metals and other ceramic materials such as silicon carbide, silicon titanate, aluminum oxide and zirconia can be used. Plastic materials such as polyethylene and polypropylene can also be used, but are generally less wear resistant.

When blade holder 74, fiberglass base 76 and blade 78 are assembled, their inclined faces combine to form a flush upstream inclined surface 103. The combination of blade holder 74 and ceramic blade 76 produces a rigid blade structure that is not subject to flex along the longitudinal axis.

Blade assembly 44 is mounted to the flattened portion 65 of lower wall 54 such that inclined surface 103 of blade assembly 44 may direct debris removed from wire 24 onto face 90 and through opening 64 and into collection box 42. Thus, face 103 acts as an inclined ramp leading from leading edge 101 of blade 78 into opening 64.

Each end 104 of collection box 42 has a drain tube 106 extending through end walls 48, 50 of housing 39. The collection box 42 can be cleaned by removing and hosing out drain tubes 106 during equipment shut down.

With blade assembly 44 mounted to blade mounting frame 12 as described above, blade 78 is positioned immediately upstream from turn shoe 34. As used herein, from and adjacent to turn shoe 34. Blade 78 is preferably positioned as close as possible to turn shoe 34, upstream therefrom. By minimizing the distance between blade 78 and turn shoe 34, the risk that debris will fall onto wire 24 downstream of blade 78 (and therefore not be removed by the blade), is reduced.

Operation

The vertical position of blade mounting frame 12 is adjusted so that the entire bottom surface 102 of blade 78 contacts wire 24. Thus, shims 62 are inserted between plate 26 and housing 39 until the bottom surface of the blade contacts the wire across the entire width of blade 78. The vertical height of the blade relative to the wire is adjusted such that the blade just contacts the wire. Since the wire is under tension and is taut, contact between the longitudinally rigid blade and the wire is maintained over the entire width of the wire as the wire rotates. Bottom surface 102 of the blade is substantially parallel to the forming wire to prevent excessive wear of the wire.

In operation, debris 110 falls onto the inner surface 36 of the rotating wire 24 upstream from the turn shoe assembly and the blade mounting frame. The debris typically falls onto the wire during start-up of the machine, but may fall onto the wire at any time. Rotation of the wire in the direction shown by the arrows carries the debris toward the turn shoe assembly and the blade.

In a preferred embodiment, at all times when the wire is rotating, a continuous supply of water is provided to shower 40. Thus, shower heads 70 continually direct water against the moving wire immediately upstream from leading edge 101 of blade 78. As the debris on moving wire 24 moves toward leading edge 101, which is in contact with wire 24, water is sprayed onto the debris. The water fluidizes the debris on the wire, and thereby tends to flush debris from the wire making removal of debris caught in the wire easier. The water also functions as a medium for transporting and carrying the debris from the wire. Finally, the water lubricates and cools the wire. In an alternative embodiment, shower 40 may be omitted.

Forming wire 24 rotates very rapidly, typically at rates of up to 2,500 feet per minute or more. As wire 24 moves past leading edge 101, debris 110 on the wire impinges on leading edge 101, and is forced by the velocity at which it is moving, and by the rotation of the wire along and up inclined face 103. The pressure between bottom surface 102 of blade 78 and inner surface 34 of wire 24 is sufficient to prevent most debris on the wire from passing the blade assembly.

Debris removed from the wire does not necessarily travel initially through openings 64 and into the U-shaped collection box 42 of housing 39 because debris tends to initially accumulate on the inclined face 103 of blade assembly 44. However, when a sufficient amount of debris has been removed from the wire and accumulates on face 103, the debris is forced over blade assembly 44, through openings 64 and into collection box 42. Debris may also move to the outer lateral edges of the wire, eventually falling off the wire.

Removal of debris from the wire substantially decreases the wear on wire 24, increasing the useful life of the wire and the quality of the paper formed thereon. Removal of debris before it gets caught in nips 39 also reduces the risk of damage to shoes 16 and 18.

By removing debris 110 upstream from the turn shoes, the debris does not reach the turn shoes, and consequently does not get trapped in nips 39.

While the present invention has been described with reference to preferred embodiments, it is to be understood that certain substitutions and alterations may be made thereto without departing from the spirit and scope of the invention as set forth in the appended claims.

I claim:

1. A turn-guide assembly for guiding and turning a forming wire at a wet end of a papermaking machine, the turn-guide assembly comprising:

a support structure adjacent the wet end;

at least one turn-guide mounted to the support structure upstream of and adjacent to the wet end, the turn-guide having a convex guide surface;

an endless forming wire movably mounted on the support structure for unidirectional travel over the convex guide surface of the turn-guide toward the wet end, the path of travel of the forming wire including a straight path portion upstream of the turn-guide and a curved path portion over the turn-guide where the wire changes direction such that the inner surface of the wire and the convex surface of the turn-guide define a nip therebetween, the nip tending to collect any debris carried into the nip on the inner surface of the wire, the forming wire along the straight path portion being relatively dry compared to the forming wire downstream of the straight path portion at the wet end; and a stationary blade carried by the support structure and spaced upstream from the turn-guide along the straight path portion, the blade including a leading edge extending transversely of the forming wire throughout substantially the entire width of the wire and engaging the inner surface of the wire to remove debris from the wire as the wire moves past the blade and toward the nip of the turn-guide.

2. The turn-guide assembly according to claim 1, wherein the blade is removably mounted to the support structure.

3. The turn-guide assembly according to claim 1 wherein the turn-guide assembly includes means for varying the pressure between the wire and the blade.

4. The turn-guide assembly according to claim 1, wherein the blade has a bottom surface that is substantially in contact with the wire.

5. The turn-guide assembly according to claim 1, including means for applying liquid to the wire upstream from the leading edge of the blade.

6. The turn-guide assembly according to claim 5, wherein the means for applying fluid comprises a shower head configured for spraying fluid onto the inner surface of the wire substantially across the width of the wire.

7. The assembly of claim 1 wherein the blade includes a leading surface inclined upwardly and rearwardly in the direction of travel of the wire from the leading edge such that the debris removed from the wire by the leading edge is deflected upwardly and rearwardly along the leading surface.

8. The assembly of claim 7 including a shower head carried by the support structure and positioned upstream of the blade for discharging liquid onto the inner surface of the wire to fluidize debris on the inner surface before the debris reaches the blade and help carry the fluidized debris away from the inner surface and onto the blade leading surface.

9. In a papermaking machine having a wet end and in which an endless forming wire travels unidirectionally in a circuitous path about a support structure at the wet end including guide means defining the path and over which the forming wire travels, the guide means including a turn-guide just upstream of the wet end having a convex surface over which the wire travels where the path changes direction leading to the wet end, the path including a straight path portion upstream of the wet end where the wire is relatively dry transitioning into a generally curved path portion at the wet end, the wire traveling toward the wet end over the convex surface of the turn-guide where the wire changes direction from the straight path portion to the curved path portion to define a nip between an inner surface of the wire and the convex surface of the turn-guide into which debris is normally carried on the inner surface of the wire;

an apparatus for removing debris collected on the inner surface of the wire before the wire reaches the nip and the turn-guide to prevent debris from collecting in the nip and thus minimize wire wear at the turn-guide, the apparatus comprising:

a debris collection blade carried by the support structure and spaced upstream of the turn-guide along the straight path portion, the blade including a leading edge portion extending transversely throughout substantially the entire width of the forming wire in contact with the inner surface of the wire along the straight path portion, the blade further including an inclined leading surface behind the leading edge portion inclined upwardly and downstream from the leading edge portion to deflect debris from the wire onto the leading surface.

10. Apparatus according to claim 9 including a shower head carried by the support structure just upstream of the blade for discharging liquid onto the inner surface of the wire ahead of the blade to cool the wire, fluidize the debris, lubricate the blade and wire and carry the debris over the blade.

11. Apparatus according to claim 9, wherein the blade is removably fastened to the support structure.

12. Apparatus according to claim 9, wherein the blade includes a wire-engaging blade portion formed of a ceramic material.

13. Apparatus according to claim 12, wherein the blade is made of silicon nitride.

14. Apparatus according to claim 9, wherein the blade includes a wire-engaging blade portion formed of a plastic material.

15. Apparatus according to claim 9, wherein the blade contacts the wire upstream from the turn-guide, the turn-guide comprising a stationary guide shoe configured for guiding the wire around the support structure.

16. Apparatus according to claim 9, wherein the blade is urged against the wire, and including means for varying the pressure of the blade against the wire.

17. A turn-shoe assembly for a paper making machine, the turn-shoe assembly comprising:

a wet-end support structure having forward and rearward ends and an underside;

at least one ceramic shoe attached to the rearward end of the support structure, the ceramic shoe having a smooth convex outer-surface;

a blade mounting frame attached to the underside of the support structure;

an endless forming wire having inner and outer surfaces, the forming wire being movably mounted to the support structure and rotatable thereon, and the inner surface being in contact with the convex outer surfaces of the ceramic shoe;

a ceramic blade attached to the blade assembly and disposed between the blade holder and the inner surface of the forming wire, the blade including a removable leading edge in contact with the inner surface of the forming wire, the leading edge having an inclined face relative to the inner surface of the forming wire; and a shower for discharging water onto the inner surface of the wire adjacent to the blade.

18. A turn-guide assembly for guiding and turning a forming wire adjacent a wet end of a papermaking machine, the turn-guide assembly comprising:

a support structure;

at least one turn-guide having a guide surface including a curved surface portion and mounted to the support structure;

an endless forming wire movably mounted on the support structure for unidirectional travel over the turn-guide along a path of travel that includes a change of direction at the turn-guide, the forming wire having an inner surface and an outer surface the change of direction including transitioning from a straight path of travel to a curved path of travel at the curved surface portion such that a nip is formed between the inner surface of the forming wire and the guide surface of the turn-guide;

a stationary blade carried by the support structure upstream from the turn-guide relative to the direction of travel of the wire, the blade including an upstream leading edge engaging the inner surface of the wire and operable to remove debris from the wire as the wire moves past the blade; and means carried by the support structure for applying liquid to the inner surface of the wire upstream from the leading edge of the blade to fluidize debris on the inner surface of the wire and facilitate its removal therefrom by the blade.

19. A method of removing debris from the inner surface of a relatively dry section of a forming wire as the wire moves toward a wet end of a papermaking machine just before the forming wire travels over a convex surface portion of a guide surface of a stationary turn-guide just upstream from the wet end in transitioning from a straight path of travel to a curved path of travel such that a nip is formed between the inner surface of the forming wire and the guide surface of the turn-guide, the method comprising the steps:

positioning a stationary blade upstream of the turn-guide with at least an upstream-directed leading edge of the blade in contact with the inner surface of the forming wire and extending transversely across the inner surface upstream of the nip;

moving the forming wire past the blade and toward the nip while maintaining contact between the inner surface of the forming wire and the leading edge of the blade;

fluidizing the debris on the inner surface of the forming wire just upstream of the leading edge of the blade; and thereby causing the fluidized debris to be deflected by the leading edge from the forming wire and upwardly along a leading surface of the blade.

* * * * *